US007318441B1

(12) United States Patent
Clerie

(10) Patent No.: US 7,318,441 B1
(45) Date of Patent: Jan. 15, 2008

(54) KINKY COMB HAIR GROOMING TOOL

(76) Inventor: Francis Clerie, 204 Cleveland St., A-8, Orange, NJ (US) 07050

( * ) Notice: Subject to any disclaimer, the term of this patent is extended or adjusted under 35 U.S.C. 154(b) by 0 days.

(21) Appl. No.: 11/358,228

(22) Filed: Feb. 21, 2006

(51) Int. Cl.
*A45D 24/22* (2006.01)
*A45D 1/02* (2006.01)

(52) U.S. Cl. ..... 132/112; 132/227

(58) Field of Classification Search ..... 132/112–116, 132/227, 228–235, 269
See application file for complete search history.

(56) References Cited

U.S. PATENT DOCUMENTS 2,661,008 A * 12/1953 Zachary ..... 132/228
3,802,442 A * 4/1974 Serdar ..... 132/228
4,026,307 A 5/1977 Morrow
4,984,590 A 1/1991 Bachtell
5,307,825 A 5/1994 Smith
5,909,737 A * 6/1999 Ricco ..... 132/116
6,012,462 A * 1/2000 Schmittou ..... 132/113
6,955,176 B2 * 10/2005 Ackermans et al. ..... 132/112

* cited by examiner

*Primary Examiner*—Robyn Doan

(57) ABSTRACT

A hair grooming tool is disclosed. The hair grooming tool is generally used for Rastafarian men or for individuals with Rastafarian hairstyles. The hair grooming tool to be used has a main central core with a number of extensions attached to the main central core. A number of tanks are located within the main central core and the extensions attached to the main central core, with the tanks including hot oil or wax that is to be applied to hair. The extensions also include a number of blades that can be used or folded back when not in use. A control panel controls several aspects of the hair grooming tool.

9 Claims, 2 Drawing Sheets

KINKY COMB HAIR GROOMING TOOL

BACKGROUND OF THE INVENTION

1. Field of the Invention

The present invention concerns that of a new and improved health apparatus.

2. Description of the Prior Art

U.S. Pat. No. 5,307,825, issued to Smith, discloses a hair grooming tool for detangling hair that has been styled as dreadlocks.

U.S. Pat. No. 4,984,590, issued to Bachtell, discloses a hair styling comb for grooming full bodied hair.

U.S. Pat. No. 4,026,307, issued to Morrow, discloses a comb for use in grooming curling and particularly kinky hair.

SUMMARY

The present invention concerns that of a new and improved health apparatus. The health apparatus comprises a hair grooming tool that is generally used for Rastafarian men or for individuals with Rastafarian hairstyles. The hair grooming tool to be used has a main central core with a number of extensions attached to the main central core. A number of tanks are located within the main central core and the extensions attached to the main central core, with the tanks including hot oil or wax that is to be applied to hair. The extensions also include a number of blades that can be used or folded back when not in use. A control panel controls several aspects of the hair grooming tool.

There has thus been outlined, rather broadly, the more important features of a hair grooming tool that the detailed description thereof that follows may be better understood and in order that the present contribution to the art may be better appreciated. There are, of course, additional features of the hair grooming tool that will be described hereinafter and which will form the subject matter of the claims appended hereto.

In this respect, before explaining at least one embodiment of the hair grooming tool in detail, it is to be understood that the hair grooming tool is not limited in its application to the details of construction and to the arrangements of the components set forth in the following description or illustrated in the drawings. The hair grooming tool is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present hair grooming tool. It is important, therefore, that the claims be regarded as including such equivalent constructions insofar as they do not depart from the spirit and scope of the present invention.

It is therefore an object of the present invention to provide a hair grooming tool which has all of the advantages of the prior art and none of the disadvantages.

It is another object of the present invention to provide a hair grooming tool which may be easily and efficiently manufactured and marketed.

It is another object of the present invention to provide a hair grooming tool which is of durable and reliable construction.

It is yet another object of the present invention to provide a hair grooming tool which is economically affordable and available for relevant market segment of the purchasing public.

Other objects, features and advantages of the present invention will become more readily apparent from the following detailed description of the preferred embodiment when considered with the attached drawings and appended claims.

DETAILED DESCRIPTION OF THE PREFERRED EMBODIMENTS

Figure 1:
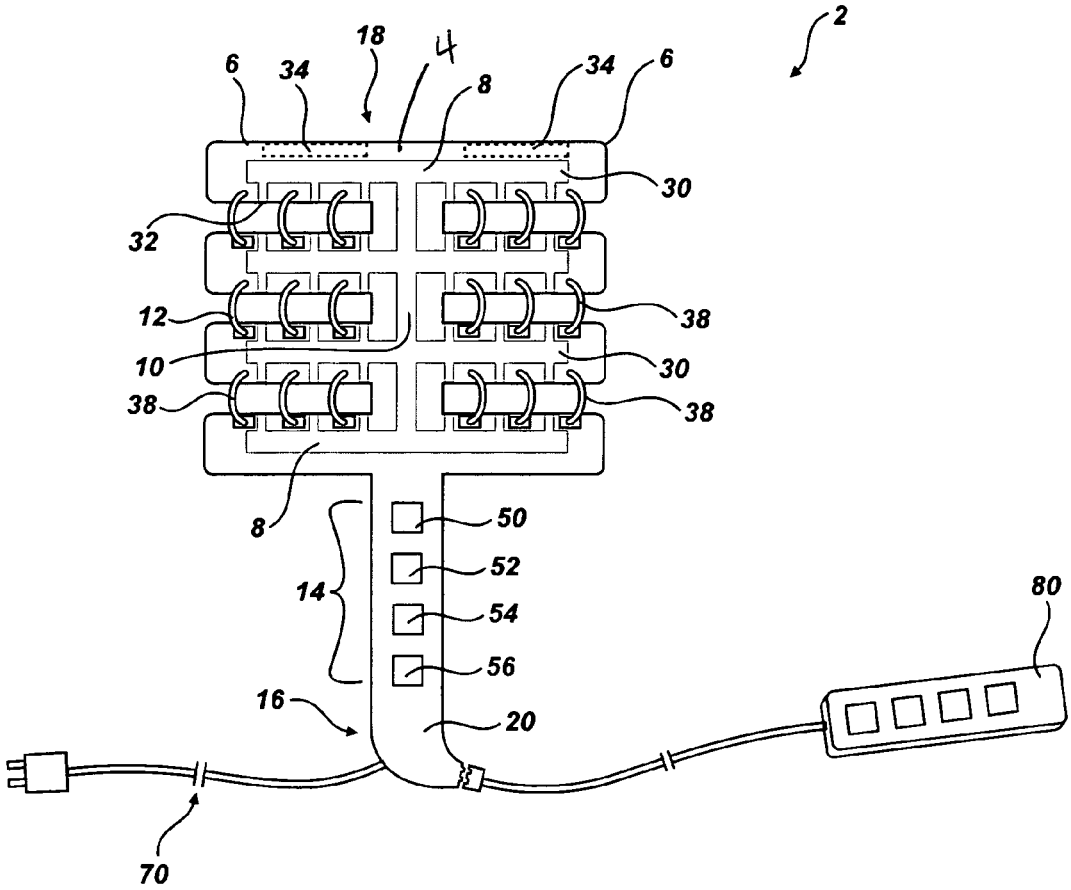
FIG. 1 is a front view illustrating the hair grooming tool, constructed in accordance with the present invention.
Figure 2:
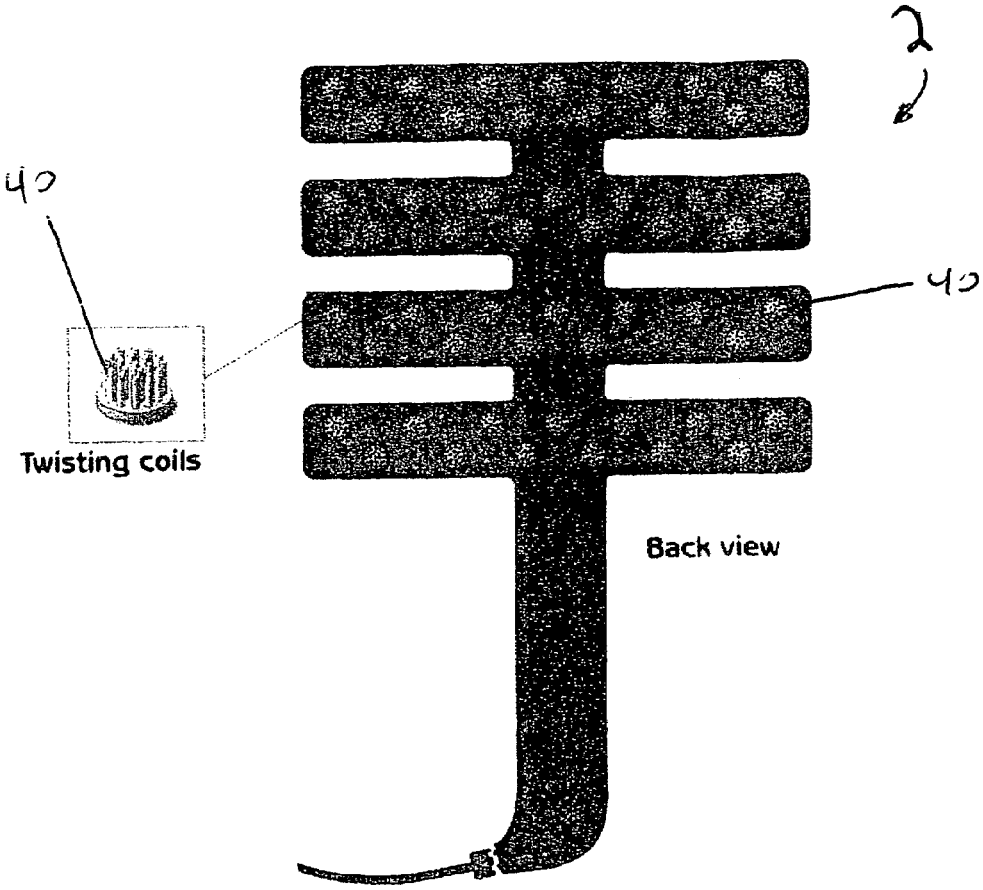
FIG. 2 is a rear view illustrating the hair grooming tool, constructed in accordance with the present invention.

FIGS. 1 and 2 illustrate a front view and a rear view of the hair grooming tool 2. The hair grooming tool 2 of the present invention can be used by anyone to style his or her hair, but it is designed for an individual that desires to keep and maintain a Rastafarian hairstyle. The hair grooming tool 2 to be used has a main central core 4 with a plurality of extensions 6 attached to the main central core 4. A number of tanks 8 are located within the main central core 4 and the extensions 6 attached to the main central core 4, with the tanks including hot oil or wax 10 that is to be applied to hair. The extensions also include a number of blades 12 that can be used or folded back when not in use. A control panel 14 controls several aspects of the hair grooming tool 2.

The core 4 has two ends comprising a handle end 16 and an extension end 18. The handle end 16 comprises a handle 20 and is the location of the control panel 14.

Attached to the hair grooming tool 2 near the extension end 18 of the core 4 is a plurality of extensions 6, with the plurality of extensions 6 extending outward from the core 4 in a perpendicular manner. Within both the core 4 near the extension end 18 of the core and the extensions 6 is located a central tank 8, which is in reality a series of interconnected tubes 30. An amount of hot material 10 is located within the tubes 30, with this hot material 10 being either hot oil or hot wax.

The extensions 6 have a plurality of outlets 32 which allow the oil or wax to exit. In addition, the extensions 6 have a plurality of heating elements 34 which provide heat to the oil or wax within the tubes 30, thereby allowing the oil or wax to have a proper viscosity to leave the outlets 32 when the hair grooming tool 2 is in use.

In addition, the extensions 6 of the hair grooming tool 2 have a plurality of adjustable blades 38, which lie flat when not in use. These adjustable blades 38 are used by an individual to cut additional unwanted hair. Furthermore, the hair grooming tool 2 has a plurality of twisting coils 40.

The control panel 14 is attached to the handle 20. The control panel 14 has several buttons, including a blade button 50, a lubricating button 52, an on/off and speed variation button 54, and a twisting initial dreadlock switch 56. The blade button 50 activates the adjustable blades 38, while the lubricating button 52 causes the tubes 30 to eject a volume of material out of the outlets 32.

Power means 70 is used to provide power to the present invention. Power means 70 is preferably standard household current. Power means 70 are connected to the control panel 14 and provide power overall to all components of the hair grooming tool 2.

An optional control panel 80 can be connected to the handle 20. Optional control panel 80 generally performs the same functions as the regular control panel 14, but allows a friendlier hand-held interface for an individual to work with on the hair grooming tool 2.

The manner of using the hair grooming tool 2 of the present invention will now be described. It will be understood by those persons skilled in the art that the manner described herein is only one manner of use and other manners of use are within the scope of the present invention.

FIG. 1—If an individual wants to trim unwanted growth of hair, he or she inserts the hair grooming tool 2 into the hair, pressing the cutting switch 50, and pulling with an upward motion. All unwanted hair and/or growth are cut off.

Depending on whether an individual wants to lubricate the scalp or hair, the he or she simply inserts the hair grooming tool 2 into the hair, as above, but pressing the lubricating switch 52 to lubricate the hair from the lubricating tank/jets 30. The speed for both can be controlled by the on/off and speed variation button 54.

FIG. 2—The back of the hair grooming tool is used to create individual dreadlocks/curls. An individual places the comb on the hair and presses the twisting switch 56. The twisting coil 40 grabs a portion of the hair and twists them into newly formed dreadlocks/curls.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A device for grooming hair, the device comprising:

a core unit having a handle and an extension end;

a plurality of extensions, each extension being attached to the core near the extension end of the core unit;

a central tank located within the core, the central tank having a plurality of interconnected tubes;

an amount of material located within the central tank and flowable through the interconnected tubes;

a plurality of heating elements located near the interconnected tubes in the central tank for heating the material;

a plurality of apertures formed in the extensions for releasing the heated material, the plurality of apertures being connected to the central tank; and a plurality of twisting coils on a rear of each extension.

2. The device of claim 1 and further comprising:

a plurality of adjustable blades attached to the plurality of extensions.

3. The device of claim 1 and further comprising:

a control panel for controlling various components of the hair grooming tool.

4. The device of claim 3 wherein the control panel includes a blade button, a lubricating button, an on/off button, and a twisting initial dreadlock switch.

5. The device of claim 1 and further comprising:

power means for powering the hair grooming tool.

6. The device of claim 5 wherein the power means includes standard household current.

7. The device of claim 1 wherein the amount of material located within central tank comprises an amount of wax.

8. The device of claim 1 wherein the amount of material located within central tank comprises an amount of oil.

9. A device for grooming hair, the device comprising:

a core unit having a handle and an extension end;

a plurality of extensions, each extension being attached to the core near the extension end of the core unit;

a central tank located within the core, the central tank having a plurality of interconnected tubes;

an amount of material located within the central tank and flowable through the interconnected tubes;

a plurality of heating elements located near the interconnected tubes in the central tank for heating the material;

a plurality of apertures formed in the extensions for releasing the heated material, the plurality of outlets being connected to the central tank; and a plurality of adjustable blades attached to the plurality of extensions.

* * * * *